United States Patent [19]

Raman et al.

[11] Patent Number: 4,854,980

[45] Date of Patent: Aug. 8, 1989

[54] REFRACTORY TRANSITION METAL GLASSY ALLOYS CONTAINING MOLYBDENUM

[75] Inventors: Ramaswamy V. Raman, Framingham; Shih C. Hsu, Weston, both of Mass.

[73] Assignee: GTE Laboratories Incorporated, Waltham, Mass.

[21] Appl. No.: 134,132

[22] Filed: Dec. 17, 1987

[51] Int. Cl.[4] ..... C22C 19/05

[52] U.S. Cl. ..... 148/403; 420/425; 420/441; 420/442; 420/447; 420/450

[58] Field of Search ..... 420/425, 580, 441, 442, 420/447, 450; 148/403

[56] References Cited

U.S. PATENT DOCUMENTS

| | | | |
|---|---|---|---|
| 3,313,633 | 4/1967 | Longo | 106/1 |
| 3,378,392 | 4/1968 | Longo | 117/93.1 |
| 3,645,727 | 2/1972 | Finlay et al. | 420/429 |
| 3,841,846 | 10/1974 | Larsen et al. | 420/429 |
| 4,059,441 | 11/1977 | Ray et al. | 75/174 |
| 4,127,410 | 11/1978 | Merrick et al. | 420/447 |
| 4,133,681 | 1/1979 | Ray | 75/170 |
| 4,146,388 | 3/1979 | Lafferty et al. | 75/0.5 AC |
| 4,389,262 | 6/1983 | Tanner | 148/403 |
| 4,556,607 | 12/1985 | Sastri | 428/627 |
| 4,576,653 | 3/1986 | Ray | 148/3 |
| 4,585,620 | 4/1986 | Kamohara et al. | 420/442 |
| 4,606,981 | 8/1986 | Mizuhara | 428/606 |
| 4,612,973 | 9/1986 | Whang | 164/508 |
| 4,701,356 | 10/1987 | Bose et al. | 427/423 |
| 4,701,357 | 10/1987 | Bose et al. | 427/423 |
| 4,702,887 | 10/1987 | Larson | 420/442 |
| 4,714,624 | 12/1987 | Naik | 427/34 |
| 4,717,538 | 1/1988 | Patrician et al. | 420/429 |
| 4,727,740 | 3/1988 | Yabuki et al. | 420/450 |
| 4,764,225 | 8/1988 | Shankar et al. | 148/404 |

OTHER PUBLICATIONS

Binary Phase Diagrams, vol. 2, ed. Massalski et al, ASM, 1986, p. 1611.

National Bureau of Standards, *Rapid Solidification Processing, Principles and Technologies, III,* p. 439, (Maryland 1982): Whang & Giessen, "An Arc Furnace Melt Spinner for the RSR Processing of Refractory and Reactive Alloys".

*Primary Examiner*—Upendra Roy

*Attorney, Agent, or Firm*—Frances P. Craig

[57] ABSTRACT

A nickel-based glassy alloy composition including Mo and one or more of Nb, Ta, and Zr, exhibiting high hardness and high crystallization temperatures.

9 Claims, No Drawings

REFRACTORY TRANSITION METAL GLASSY ALLOYS CONTAINING MOLYBDENUM

FIELD OF THE INVENTION

The invention relates to glassy metal alloy compositions, particularly to nickel-based alloys which are at least 50% glassy and include molybdenum.

BACKGROUND OF THE INVENTION

The application of metal powders as protective coatings is well known in the art and widely used. The coatings are normally deposited on a base metal by various techniques, e.g. flame spraying and plasma spraying. A dense, well bonded coating of suitable chemical composition, microstructure, and properties deposited onto a relatively inexpensive base metal is useful to economically extend the service life of a product made of the base metal, where such a product is subjected to adverse service conditions. Sprayed metal powders are also useful to produce dense, hard, high structural strength coatings for resistance to various kinds of wear, e.g. abrasive, sliding, fretting, etc. Spray coatings are also well suited for dimensional restoration of worn parts.

Conventional alloying processes greatly limit the design of alloys, including spray coating alloys, made thereby to those compositions within the limitations imposed by the corresponding equilibrium phase diagrams. These phase diagrams indicate the existence and coexistence of phases present in thermodynamic equilibrium; and alloys prepared by such processes are in, or at least approach equilibrium. The development of techniques featuring rapid quenching from the alloy melt has greatly widened the range of new alloys by making possible metastable compositions ranging further from the equilibrium state. Such new alloy compositions have unique structures and properties greatly useful in technological applications.

Various rapid solidification processes have been developed for rapidly quenching alloy melts. In the commonly used melt spinning technique, the material to be solidified is normally heated in a crucible, and is discharged through an orifice in the bottom of the crucible as a molten stream, falling onto a rapidly moving surface of high thermal conductivity, typically a spinning disk. The stream of melt is rapidly quenched by contact with the surface of the rapidly spinning disk, and is collected therefrom in the form of a filament, ribbon, wire, or flakes.

An arc furnace having a water cooled copper crucible is used for the melt spinning of refractory and reactive metals and alloys, as reported by Whang et al. ("An Arc Furnace Melt Spinner for the RSR Processing of Refractory and Reactive Alloys", *Rapid Solidification Processing, Principles and Technologies, III*, National Bureau of Standards, Maryland, (1982)). The arc furnace melt spinner reported by Whang et al. includes upper and lower chambers sealed from one another and separated by a water cooled copper crucible having a central orifice through which the upper and lower chambers are in fluid communication. In the upper chamber, an electrode arc melter positioned above the crucible melts and superheats the metal or alloy in the crucible, so that it is sufficiently fluid to be ejected through the orifice. In the lower chamber, a spinning disk is provided adjacent the orifice. During the melting process, the chambers are held at equal pressure. However, during the melt spinning process, the lower chamber is rapidly evacuated creating an overpressure in the upper chamber relative to the lower chamber, which ejects the superheated melt through the orifice as a liquid jet of melt falling onto the spinning disk, being rapidly quenched thereon, and being released therefrom as a filament.

Such rapid solidification techniques make it possible to obtain metastable solid amorphous or glassy alloy compositions outside of the normal thermodynamic equilibrium state. As used herein, the term "amorphous" or "glassy" indicates a noncrystalline solid substance, substantially lacking in any long range order, and is at least 50% amorphous, having only a minor amount of the material present as included crystallites. X-ray diffraction measurements are generally used to distinguish amorphous materials from crystalline materials. Additionally, such materials may be distinguished by transmission electron micrography and electron diffraction measurements.

Such amorphous alloys exist in a metastable state, i.e. at a sufficiently high temperature, they will crystallize, evolving the heat of crystallization, the diffraction profile of the material indicating the change from glassy or amorphous characteristics to those of the crystalline state.

The relative proportions of such substantially amorphous materials can vary from a two-phase mixture of amorphous material and included crystallites to a single phase totally amorphous alloy.

Alloy coatings for hard surfacing and structural applications are normally applied to various substrate materials by flame spraying, plasma spraying, or wire spraying. Molybdenum and molybdenum-molybdenum oxide sprayed coatings are commonly used on such substrates as pistons for internal combustion engines. Also known are coatings formed from plasma sprayed powder mixtures including both molybdenum powder and other metal alloy powder, such coating including two or more phases, and combining the abrasion resistance of the molybdenum phase and the wear resistance of the metal alloy phase. A common second phase forming powder for such coatings is a nickel base alloy as described in U.S. Pat. Nos. 3,313,633 and 3,378,392.

Alloys suitable for many different applications are known which combine nickel, and transition metals, some also including aluminum, tin, germanium, antimony, beryllium, manganese, or copper. However, nearly all of such known compositions include such metalloid elements as boron, phosphorous, carbon, and silicon. Additionally, few of these compositions are suitable for abrasion resistant applications such as hard surfacing and structural applications.

The nickel-based, substantially glassy alloys according to the invention have high thermal stability, with crystallization temperatures of about 600°–1000° C., and a high degree of hardness, with values of about 400–1300 Kg/mm$^2$. Such compositions are at least 50% glassy, highly stable, and are well suited for applications requiring a high degree of abrasion resistance, such as hard surfacing and structural applications.

SUMMARY OF THE INVENTION

The nickel based alloy according to the present invention is at least 50% glassy, and consists essentially of a composition of the formula $Mo_xM_yNi_z$. In this formula, M is at least one metal selected from niobium, tantalum, and zirconium. In the subscripts, all indicating atom percent, x is about 2.5–75, y is about 0–70, and z is about 27.5–60. The total atom percent of x+y+z is 100%.

DETAILED DESCRIPTION OF THE INVENTION

Illustrative alloys according to the present invention are ternary alloys of refractory and transition metals, combining nickel with one or more of niobium, tantalum and zirconium, and in which molybdenum is substituted for at least a portion of the niobium, tantalum, or zirconium. The addition of the molybdenum to the composition, replacing some or all of the refractory transition metal component, produces an increase in the microhardness exhibited by the alloy, thus improving its usefulness in hard surfacing and structural applications, while maintaining a metastable substantially glassy state in the alloy.

The preferred process for fabricating the alloys according to the invention involves arc melting of the components or the prealloyed material in a water cooled copper crucible having a central orifice in the crucible bottom. The molten metal is extruded, utilizing a pressure differential between the upper and lower chambers of the arc melter, as described above, onto a rotating copper wheel. Rapid solidification of the melt upon contact with the rotating copper wheel results in an amorphous or glassy microstructure possessing moderate to high microhardness and good thermal stability. The resulting alloy filament may be pulverized by standard ballmill or other standard methods. The resulting powder may be used to coat by conventional plasma spray methods a variety of substrates, resulting in improvement of the mechanical, chemical and/or thermal properties of the substrate. Suitable substrates include steel, superalloys, and niobium alloys.

Alternatively, it is anticipated that atomization of the alloy melt emerging from the water cooled crucible orifice will directly produce a rapidly solidified powder which may be similarly plasma sprayed to form the desired coating. Such atomization methods include for example those disclosed in U.S. patent application Ser. No. 76,448, filed July 22, 1987 and commonly owned with the present application. Other rapid solidification may also be suitable, particularly those producing a cooling rate of about $10^5$–$10^6$° C./sec. The preferred melt temperature for the molten composition to be rapid-quenched is a low degree of superheat, i.e. about 50° above the melting temperature.

Although the specific examples described herein of alloys according to the present invention are ternary compositions, quarternary (four component) and quintenary (five component) compositions including only the same components as those described above for the ternary compositions, are contemplated as being within the scope of the present invention. Such compositions include those including molybdenum and nickel with niobium and tantalum, with niobium and zirconium, with tantalum and zirconium, and with niobium, tantalum, and zirconium. Such compositions are within the atomic ratios described above, the total atom percent of niobium, zirconium, and tantalum not exceeding about 70%. Also contemplated as being within the scope of the invention are certain binary compositions of molybdenum and nickel exhibiting a microhardness exceeding about 400 Kg/mm$^2$, preferably exceeding about 700 Kg/mm$^2$, as described below.

EXAMPLES

A number of alloy compositions were fabricated by an arc melting process, as described by Whang et al. in the above-referenced article. (The Whang et al. article is incorporated herein by reference as an example of a preferred processing method for producing the alloys according to the invention.) The compositions, and the results obtained by testing the various alloys by x-ray diffraction, standard microhardness testing, and differential thermal analysis, are listed below in the Table.

TABLE

| Ex. # | Composition | X-ray Diffrn. | $T_c$, °C. | $T_m$, °C. | mHdness, Kg/mm$^2$ |
|---|---|---|---|---|---|
| 1* | $Nb_{60}Ni_{40}$ | — | 729.0 | 1286 | 915 |
| 2 | $Mo_5Nb_{55}Ni_{40}$ | — | 742.2 | 1285 | 926 |
| 3 | $Mo_{10}Nb_{50}Ni_{40}$ | — | 747.2 | 1275 | 944 |
| 4 | $Mo_{20}Nb_{40}Ni_{40}$ | — | 795.8 | 1231 | 985 |
| 5 | $Mo_{40}Nb_{20}Ni_{40}$ | — | — | — | 1086 |
| 6 | $Mo_{60}Ni_{40}$ | — | 806.3 | 1363.7 | 1234 |
| 7* | $Nb_{49}Ni_{51}$ | amorph. | — | — | 750 |
| 8 | $Mo_4Nb_{45}Ni_{51}$ | amorph. | — | — | 807 |
| 9 | $Mo_8Nb_{41}Ni_{51}$ | ptl. am. | — | — | 854 |
| 10 | $Mo_{15.8}Nb_{32.6}Ni_{51.6}$ | amorph. | — | — | 985 |
| 11 | $Mo_{31.7}Nb_{16.4}Ni_{51.9}$ | ptl. am. | — | — | 1186 |
| 12 | $Mo_{48}Ni_{52}$ | ptl. am. | — | — | 1241 |
| 13* | $Nb_{40}Ni_{60}$ | — | — | — | 819 |
| 14 | $Mo_5Nb_{35}Ni_{60}$ | — | — | — | 926 |
| 15 | $Mo_{10}Nb_{30}Ni_{60}$ | — | — | — | 940 |
| 16 | $Mo_{20}Nb_{20}Ni_{60}$ | — | — | — | 1021 |
| 17 | $Mo_{40}NI_{60}$ | — | — | — | 491 |
| 18* | $Nb_{29.6}Ni_{70.4}$ | amorph. | — | — | 869 |
| 19 | $Mo_{3.6}Nb_{26}Ni_{70.4}$ | ptl. am. | — | — | 889 |
| 20 | $Mo_{7.2}Nb_{22.3}Ni_{70.5}$ | ptl. am. | — | — | 930 |
| 21 | $Mo_{14.4}Ni_{14.9}Ni_{70.7}$ | ptl. am. | — | — | 946 |
| 22 | $Mo_{29}Ni_{71}$ | ptl. am. | — | — | 441 |
| 23* | $Ta_{40}Ni_{60}$ | — | — | — | 948 |
| 24 | $Mo_5Ta_{35}Ni_{60}$ | — | — | — | 1008 |
| 25 | $Mo_{10}Ta_{30}Ni_{60}$ | — | — | — | 1046 |
| 26 | $Mo_{20}Ta_{20}Ni_{60}$ | — | — | — | 1102 |
| 27* | $Ta_{18}Ni_{82}$ | ptl. am. | — | — | 555 |
| 28* | $Mo_4Ta_{15}Ni_{81}$ | ptl. am. | — | — | 570 |
| 29* | $Mo_8Ta_{13}NI_{79}$ | ptl. am. | — | — | — |
| 30* | $Mo_{16}Ta_8Ni_{76}$ | ptl. am. | — | — | 602 |
| 31* | $Zr_{40}Ni_{60}$ | — | — | — | 653 |
| 32 | $Mo_5Zr_{35}Ni_{60}$ | — | — | — | 734 |
| 33 | $Mo_{10}Zr_{30}Ni_{60}$ | — | — | — | 749 |
| 34 | $Mo_{20}Zr_{20}Ni_{60}$ | — | — | — | 1059 |
| 35 | $Mo_{30}Zr_{10}Ni_{60}$ | — | — | — | 1132 |

* = comparative examples
ptl. am. = partly amorphous

As may be seen from the Table, microhardness increases with increasing molybdenum substitution for the refractory alloys, except for the binary compositions of examples 17 and 22. Further, except for examples 17 and 22, the compositions within the ranges of the alloy according to the invention were at least 700 Kg/mm$^2$, and most are at least 800 Kg/mm$^2$.

The refractory-transition metal alloys according to the invention, rapid quenched from the melt and at least 50% glassy, exhibit improved microhardness and are thermally stable. The alloys according to the invention are expected to show improved performance in hard surfacing and structural applications over known alloys.

While there has been shown and described what are at present considered the preferred embodiments according to the invention, it will be obvious to those skilled in the art that various changes and modifications may be made therein without departing from the scope of the invention as defined by the appended claims.

We claim:

1. An alloy at least 50% glassy, and consisting essentially of a composition of the formula $$Mo_xM_yNi_z$$

wherein M is at least one metal selected from the group consisting of Nb, Ta, and Zr; x is about 2.5–75, y is about 0–70, z is about 27.5–60, and $x+y+z=100$, all subscripts being expressed in atom percent; and wherein the alloy exhibits a crystallization temperature of at least about 600° C. and a hardness of at least about 400 $Kg/mm^2$.

2. An alloy according to claim 1 consisting essentially of a composition of the formula $$Mo_{40}Nb_{20}Ni_{40}$$

3. An alloy according to claim 1 consisting essentially of a composition of the formula $$Mo_{20}Nb_{20}Ni_{60}$$

4. An alloy according to claim 1 consisting essentially of a composition of the formula $$Mo_5Ta_{35}Ni_{60}$$

5. An alloy according to claim 1 consisting essentially of a composition of the formula $$Mo_{10}Ta_{30}Ni_{60}$$

6. An alloy according to claim 1 consisting essentially of a composition of the formula $$Mo_{20}Ta_{20}Ni_{60}$$

7. An alloy according to claim 1 consisting essentially of a composition of the formula $$Mo_{20}Zr_{20}Ni_{60}$$

8. An alloy according to claim 1 consisting essentially of a composition of the formula $$Mo_{30}Zr_{10}Ni_{60}$$

9. An alloy according to claim 1 consisting essentially of a composition of the formula $$Mo_{60}Ni_{40}$$

* * * * *